US010207864B2

(12) United States Patent
McBride

(10) Patent No.: US 10,207,864 B2
(45) Date of Patent: Feb. 19, 2019

(54) WASTE BIN LINERS AND METHODS OF USE

(71) Applicant: Brandon Thomas McBride, St. Albert (CA)

(72) Inventor: Brandon Thomas McBride, St. Albert (CA)

( * ) Notice: Subject to any disclaimer, the term of this patent is extended or adjusted under 35 U.S.C. 154(b) by 89 days.

(21) Appl. No.: 15/216,926

(22) Filed: Jul. 22, 2016

(65) Prior Publication Data

US 2017/0022004 A1 Jan. 26, 2017

Related U.S. Application Data

(60) Provisional application No. 62/195,697, filed on Jul. 22, 2015, provisional application No. 62/250,086, filed on Nov. 3, 2015, provisional application No. 62/317,133, filed on Apr. 1, 2016.

(51) Int. Cl.

| | |
|---|---|
| ***B65F 1/08*** | (2006.01) |
| ***B65F 1/06*** | (2006.01) |
| ***B65F 1/14*** | (2006.01) |

(52) U.S. Cl.

CPC ..... *B65F 1/08* (2013.01); *B65F 1/067* (2013.01); *B65F 1/1468* (2013.01); *B65F 2210/148* (2013.01)

(58) Field of Classification Search

CPC ..... B65F 1/08; B65F 1/068; B65F 2220/12; B65F 2210/18; B65D 5/566; B65D 23/02

USPC ..... 220/908, 23.89, 495.08

See application file for complete search history.

(56) References Cited

U.S. PATENT DOCUMENTS 1,173,468 A * 2/1916 Trafton ..... B65F 1/06 220/495.04
1,187,498 A * 6/1916 Castle ..... A61L 2/26 134/135
1,608,901 A * 11/1926 Miller ..... B65D 33/14 220/495.08
1,836,297 A 12/1931 Vienna (Continued)

FOREIGN PATENT DOCUMENTS

DE 202005004899 U1 7/2005
EP 1172307 A1 1/2002

(Continued)

OTHER PUBLICATIONS

Recycling liner for resin step-on container, Screenshots taken from Lalema website, URL=http://www.lalema.com/product/recycling-liner-resin-step-on-containers-eight-gallons-20448/, accessed on Sep. 2, 2016, believed to have been available at least as early as Jul. 21, 2015, 2 pages.

(Continued)

*Primary Examiner* — Jeffrey Allen
*Assistant Examiner* — Jennifer Castriotta
(74) *Attorney, Agent, or Firm* — Robert A. Nissen

(57) ABSTRACT

Waste bin liners, such as rigid liners, methods of using waste bin liners, and combinations of waste bins with a liner, are disclosed. In one example hook parts of a waste bin liner are extended in sequence over and under a perimeter rim of a waste bin, and laterally inward of a part of the perimeter rim. In one example a rigid liner has multi-purpose hook parts that lock to the rim of a waste bin, and also form lifting handles for removing the liner from the bin.

18 Claims, 7 Drawing Sheets

(56) References Cited

U.S. PATENT DOCUMENTS

| | | | | | |
|---|---|---|---|---|---|
| 1,886,406 | A | | 11/1932 | Kniffin | |
| 1,980,715 | A | * | 11/1934 | Brosler | B65F 1/08 220/23.89 |
| 2,046,777 | A | * | 7/1936 | Geibel | B65F 1/08 220/23.87 |
| 2,433,945 | A | | 1/1948 | Foreman | |
| 2,498,016 | A | * | 2/1950 | Stine | B65D 25/18 220/23.89 |
| 2,634,880 | A | | 4/1953 | Gravatt | |
| 4,390,110 | A | | 6/1983 | Pirro | |
| 4,878,592 | A | | 11/1989 | Lee | |
| 4,948,266 | A | * | 8/1990 | Bencic | A47L 9/1445 220/495.08 |
| 4,974,746 | A | | 12/1990 | Dickinson | |
| 5,092,480 | A | * | 3/1992 | Waterston | B65F 1/0053 220/23.4 |
| 5,222,704 | A | * | 6/1993 | Light | B65F 1/06 220/495.08 |
| 5,598,942 | A | | 2/1997 | Cowie | |
| 5,735,495 | A | | 4/1998 | Kubota | |
| 5,803,299 | A | * | 9/1998 | Sealy, Jr. | B65F 1/062 220/495.07 |
| 8,714,394 | B2 | | 5/2014 | Wulf | |
| 8,887,941 | B2 | | 11/2014 | Heintzman | |
| 2002/0130224 | A1 | | 9/2002 | Asaro | |
| 2004/0001653 | A1 | | 1/2004 | Carr et al. | |
| 2008/0044111 | A1 | | 2/2008 | Faraone | |
| 2008/0053318 | A1 | * | 3/2008 | van Beuningen | B65F 1/06 100/226 |
| 2009/0071964 | A1 | * | 3/2009 | Phipps | B65F 1/06 220/495.08 |
| 2010/0147865 | A1 | | 6/2010 | Yang et al. | |

FOREIGN PATENT DOCUMENTS

| | | | |
|---|---|---|---|
| FR | 2834976 | A1 | 7/2003 |
| GB | 2409154 | A | 6/2005 |
| GB | 2474874 | A | 5/2011 |
| GB | 2482690 | A | 2/2012 |
| WO | 2012101291 | A1 | 8/2012 |

OTHER PUBLICATIONS

Round Red Step Style Trash Bin with Liner, Screenshots taken from Big Kitchen website, URL=http://www.bigkitchen.com/round-red-step-style-waste-bin-with-liner.html, accessed on Nov. 1, 2016, believed to have been available at least as early as Jul. 21, 2015, 2 pages.

Screenshots taken from Global Industries Website—Hooded Top Waste Containers, URL=http://www.globalindustrial.ca/g/janitorial-maintenance/garbage-recycling/containers-outdoor-plastic/carlisle-56-gallon-hooded-top-waste-containers-95647, accessed on Mar. 20, 2015, 2 pages.

Screenshots taken from Global Industries Website—Carlisle Rigid Liner, URL=http://www.globalindustrial.ca/p/janitorial-maintenance/garbage-recycling/containers-outdoor-plastic/rigid-liner-42-gallon-black, accessed on Mar. 20, 2015, 2 pages.

Screenshots taken from Global Industries Website—Rigid Liner for Rubbermaid Plaza Receptacle, URL=http://www.globalindustrial.ca/p/janitorial-maintenance/garbage-recycling/containers-outdoor-plastic/rigid-liner-rubbermaid-plaza-receptacle-gray, accessed on Mar. 20, 2015, 2 pages.

* cited by examiner

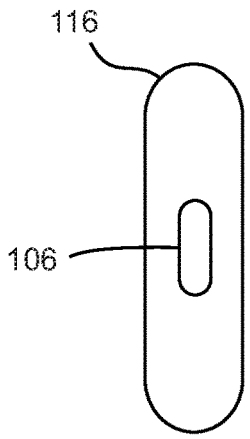
Fig. 8A
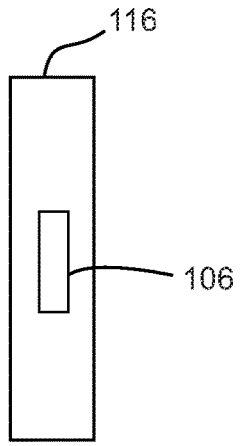
Fig. 8B
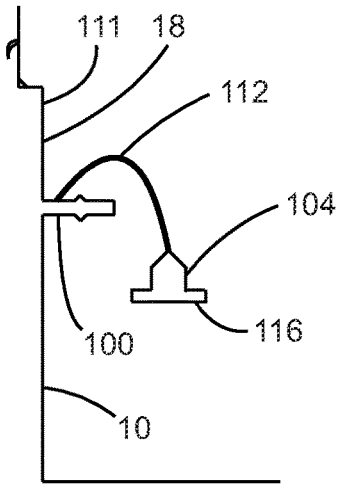
Fig. 9
Fig. 10
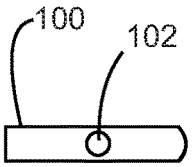

WASTE BIN LINERS AND METHODS OF USE

TECHNICAL FIELD

This document relates to waste bin liners and methods of use.

BACKGROUND

Waste, or garbage, is stored in bins, which may be positioned inside the house, or outdoor for pickup by local authorities. It is known to insert a rigid liner into a plastic waste container.

SUMMARY

Waste bin liners, such as rigid liners, methods of using waste bin liners, and combinations of waste bins with liners, are disclosed. In one example hook parts of a waste bin liner are extended in sequence over and under a perimeter rim of a waste bin, and laterally inward of a part of the perimeter rim. In one example a rigid liner has multi-purpose, hook parts that lock to the rim of a waste bin, and reposition when unlocked to form lifting handles for removing the liner from the bin. The liners disclosed here may be an extra expense and redundant protection for an already durable rigid waste bin receptacle, but may provide a disposable mechanism for reducing the cleaning burden, and thus increasing the convenience of use, of the waste bin itself.

A method is disclosed, comprising: inserting a rigid liner into a receptacle of a waste bin, the rigid liner conforming to an interior shape of the receptacle; and extending a plurality of hook parts from the rigid liner in sequence over and under a perimeter rim of the waste bin to lock the rigid liner to the waste bin.

A rigid liner for a waste bin is disclosed, the waste bin having a receptacle, the rigid liner comprising; a side wall and base that collectively define a receptacle conforming exterior surface; and a plurality of hook parts extended, in a locked position, from a top part of the rigid liner in sequence laterally outward, down and laterally inward.

In various embodiments, there may be included any one or more of the following features: Each hook part connects to the rigid liner by a respective hinge. Each hinge has a hinge axis parallel to a part of a perimeter axis of the rigid liner that is adjacent the hinge, and extending further comprises rotating each hooking part in a downward direction into a locked position. Unlocking the plurality of hook parts from the perimeter rim. Lifting the rigid liner from the waste bin by gripping the plurality of hook parts. The perimeter rim is formed by a bin ledge and a skirt, the bin ledge extended laterally outward from a top part of the waste bin, with the skirt depending from the bin ledge. Each hook part has an arm with a hook tip that projects upward and laterally inward from the arm, and laterally inward of the skirt, when in the locked position. Each hook tip and arm collectively define a finger receiving cavity that faces downward when in the lifting position. Each hook part has a range of motion about the respective hinge between the locked position and the lifting position, the range of motion being at least ninety degrees. The range of motion is at least one hundred eighty degrees. An end of each arm connects to the hinge axis, and the arm stands vertically upright when in the lifting position. Each finger receiving cavity comprises a plurality of finger receiving grooves. Rotation, past the lifting position in a direction away from the locked position, is limited by a stop associated with the respective hinge. Each stop comprises a projection from an exterior surface of the respective arm adjacent the hinge. The projection has the shape of a triangle in a cross-sectional plane perpendicular to the hinge axis, in which an edge, of the triangle, that is closest to the hinge extends perpendicular to the exterior surface of the respective arm. Each hook tip has, in a cross-sectional plane perpendicular to the hinge axis, a curved exterior surface and a curved interior surface, the curved exterior surface and the curved interior surface converging together at a tip edge. Each hinge defines an outer lateral edge of a liner ledge, which is extended laterally over the perimeter rim. A plurality of bags are nested within the rigid liner, each bag conforming to an interior shape of the rigid liner. Each bag forms first and second tabs that project out of a top part of the bag. The first tabs of each bag are layered upon each other to form a first stack of tabs, and the second tabs of each bag are layered upon each other to form a second stack of tabs. Each bag forms third and fourth tabs that project out of the top part of the bag, the third tabs of each bag are layered upon each other to form a third stack of tabs, the fourth tabs of each bag are layered upon each other to form a fourth stack of tabs, and the first stack, second stack, third stack, and fourth stack are located adjacent respective top corners of the bin liner. The rigid liner contains a plurality of first parts, each being one of a male or female part and mounting a respective second part that is the other of a male or female part, and supporting one or more of the plurality of bags between the first part and the respective second part.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which:

FIGS. 8A-8B are end views of the rounded (FIG. 8A) and rectangular (FIG. 8B) bore variants of female parts used to mate with corresponding male part shown in FIG. 11.

FIG. 9 is a side elevation view of the liner, male part and female part connected to the male part via a tether.

FIG. 10 is a top plan view of the rounded liner male part.

DETAILED DESCRIPTION

Immaterial modifications may be made to the embodiments described here without departing from what is covered by the claims.

Waste bins are used to store waste for a period of time prior to being transported to a disposal, processing, or recycling facility. Many local authorities distribute standardized waste bins for accumulating waste for curb side pickup. During use waste bins tend to get soiled, which may occur as a result of continual direct contact with waste if no flexible bag liner is used to protect the waste bin, or from indirect or occasional contact with waste that leaks or falls from a flexible bag liner within the waste bin. A soiled waste bin may harbor various pathogens and toxic materials, thus presenting a sanitary hazard. In addition, a soiled waste bin may release noxious odors every time a lid is removed to access the interior of the waste bin. Waste bins tend to be large, rugged, reusable items that are difficult to clean and expensive to replace.

Figure 1:
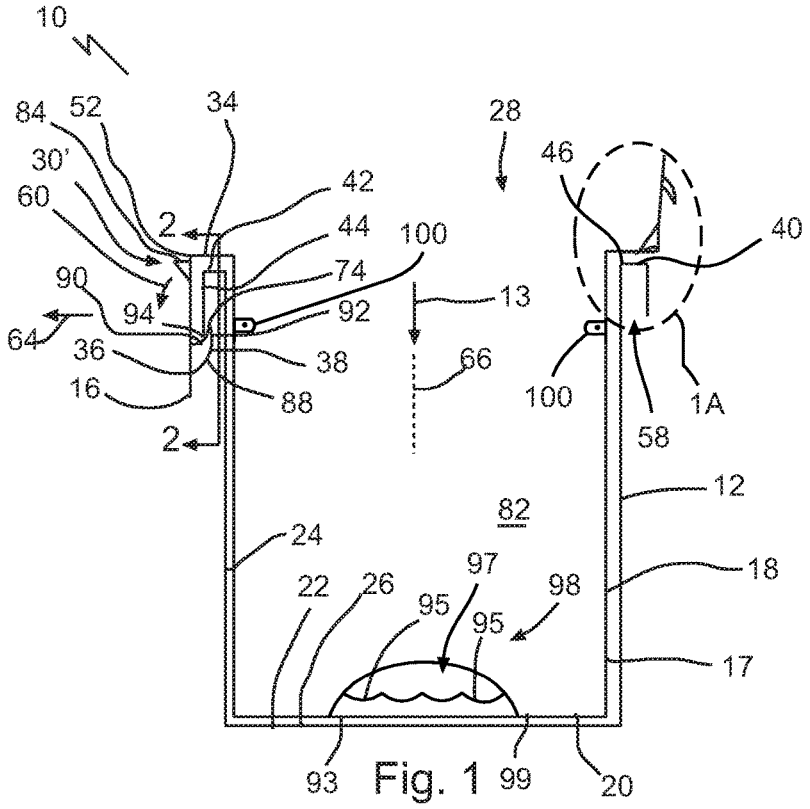
FIG. 1 is a side elevation section view of a rigid liner inserted within a waste bin, with hook parts in a locked position (left hook part) and lifting position (right hook part).
Figure 1A:
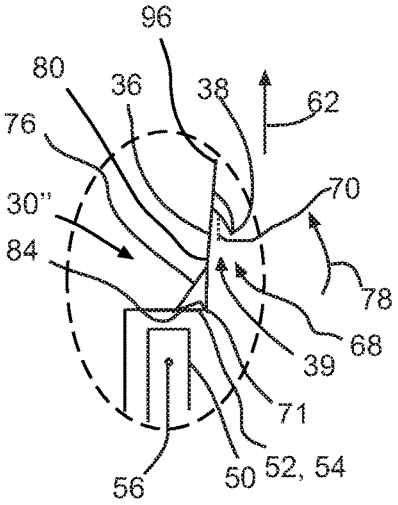
FIG. 1A is a close up view of the area in FIG. 1 that is bounded by dashed lines and identified by reference numeral 1A.

Referring to FIGS. 1 and 1A, a rigid liner 10 for a waste bin 12 is illustrated, along with a method of using same. In use the rigid liner 10 is inserted, for example along direction line 13, into a receptacle 16 of waste bin 12. The rigid liner 10 conforms to an interior shape of the receptacle 16, for example, exterior surfaces 17 defined by a side wall 18 and base 20 of the rigid liner 10 conforms to interior surfaces 22 defined by a side wall 24 and base 26 of the waste bin 12. Conforming may mean that the liner 10 nests within the waste bin 12, for example if the liner 10 side wall 18 and base 20 are shaped to continuously contact the bin 12 side wall 24 and base 26 from a top end 28 of the bin 12 to the base 26. A plurality of hook parts 30 are connected to the rigid liner 10, and extend, in a locked position such as shown by hook part 30', from a top part or end 32 of the rigid liner 10 in sequence laterally outward (for example shown by liner ledge 34), down (for example shown by arm 36) and laterally inward (for example shown by hook tip 38).

In use, the hook parts 30 are extended, for example from an unlocked position shown by hook part 30" into the locked position shown by hook part 30', from the rigid hollow liner 10 in sequence over and under a perimeter rim 40 of the waste bin 12 to lock the rigid liner 10 to the waste bin 12. Thus, the hook parts 30 form a rim underside gripping or receiving part. The perimeter rim 40 may be formed by a bin ledge 42 and a skirt 44, with the bin ledge 42 extended laterally outward from a top part or end 46 of the waste bin 12, and the skirt 44 depending from the bin ledge 42. In effect, a top part 46 of the bin side wall 18 may have the appearance of being folded laterally outward (ledge 42) and downward (skirt 44) to form a reinforced perimeter rim 40. In the locked position (hook part 30') the liner ledge 34 and arm 36 may conform to exterior surfaces 50 of the bin ledge 42 and skirt 44. The hook parts 30 may lock by applying axial pressure to a top surface, for example liner ledge 34, of the hook part 30.

Each hook part 30 may connect to the rigid liner 10 by a respective hinge 52. Each hinge 52 may have a hinge axis 54 parallel to a part of a perimeter axis 56, of the rigid liner 10, that is adjacent the hinge 52. For example, the hinge axis 54 may be tangent and parallel to the perimeter axis 56. In the example shown the perimeter axis 56 is also an axis of a rim underside channel 58 formed between the skirt 44, bin ledge 42, and side wall 24. Extending the hook parts 30 from unlocked to locked may further comprise rotating each hooking part 30 in a downward direction 60, for example from an unlocked position (part 30") into a closed or locked position (part 30').

The hook parts 30 may double as rim locking parts and lifting handles for lifting the liner 10 out of the bin 12. Thus, the method may comprise unlocking the plurality of hook parts 30 from the perimeter rim 40, for example by applying a force in a laterally outward direction 64 to hook 30', direction 64 being defined perpendicular to bin axis 66. Once moved out of the downward locked position, for example after moving the hook parts into an upward lifting position (hook part 30"), the rigid liner 10 may be lifted or pulled out from the waste bin 12 by gripping the plurality of hook parts 30, and applying a force in an upward direction 62 parallel to the bin axis 66.

Figure 2:
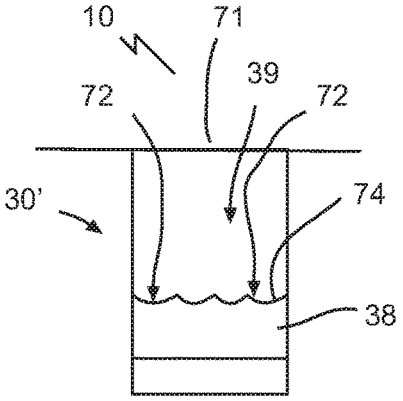
FIG. 2 is a section view taken along the 2-2 view lines from FIG. 1.

Each hook part 30 may have an arm 36 with a hook tip 38 that projects upward and laterally inward from the arm 36, and laterally inward of the skirt 44, when in the locked position (hook part 30'). When in the lifting position (hook part 30"), each hook tip 38 and arm 36 may collectively define a finger receiving cavity 39 whose access opening 68 opens in a downward direction 13. For example the cavity 39 may define a finger insertion axis 70 that is parallel with the bin axis 66 in the lifting position. Referring to FIG. 2, each finger receiving cavity 39 may comprise a plurality of finger receiving grooves 72, which may be formed at least in part by scalloping a terminal edge 74 of the hook tip, tooth, or teeth 38.

Referring to FIGS. 1 and 1A, each hook part 30 may have a range of motion about the respective hinge 52 between the locked position (hook part 30') and the lifting position (hook part 30"), the range of motion being at least ninety degrees and in the example shown, one hundred eighty degrees. In order to achieve such range the hinge 52 may be a flexible hinge with nominal to no natural biasing effect in any direction, thus permitting relatively free movement about the hinge 52. The pivot point or hinge 52 may be formed of a living hinge as shown, such as by producing hinges 52 by incorporating relatively thinned portions of the material that makes up the structure of the liner 10.

Figure 3:
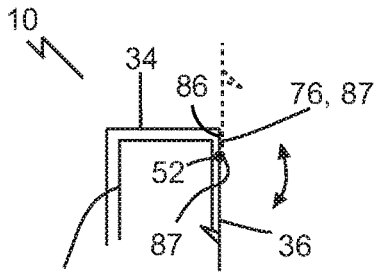
FIG. 3 is a side elevation section view of another embodiment of a hook part.

Referring to FIGS. 1 and 1A, a stop 76 may be associated with each respective hinge 52, to limit rotation of swing arm 36, which may have a linear cross-sectional shape as shown, past the lifting position (hook part 30") in a direction 78 away from the locked position (hook part 30'). Each stop 76 may comprise a projection, such as a triangle as shown, from an exterior surface 80 of the respective arm 36 adjacent the hinge 52. Thus, in some cases the stop 76 has the shape of a triangle in a cross-sectional plane 82 perpendicular to the respective hinge axis 54, and in some cases parallel to, and in further cases including, a waste bin axis 66 (the cross-sectional plane being defined by the page illustrating the section view in FIG. 1). A triangle wall 84, of the triangle, that is closest to the hinge 52 may extend perpendicular to the exterior surface 80 of the respective arm 36. Thus, once the arm 36 rotates within 90 degrees relative to the liner ledge 34, the wall 84 contacts the liner ledge 34 to stop further rotation from occurring, and also to stabilize the hook parts 30 in the lifting position from lateral wobbling about hinge 52. Lateral wobbling may otherwise be caused by a range of possible movement about hinge 52 when in the lifting position. Wobbling can be reduced or cut in half and in some cases removed particularly if a user applies a slight laterally inward force to engage stop 76 and ledge 34. Referring to FIG. 3, another embodiment of a stop 76 is provided by positioning hinge 52 at a base end 87 of a liner skirt 86 to which arm 36 connects, so that when arm 36 rotates into the vertical lifting position shown in dashed lines, the liner skirt 86 stops further rotation. Referring to FIGS. 1 and 1A, in the example shown each hinge 52 defines an outer lateral edge of the liner ledge 34, which is extended laterally over the perimeter lip 14 when in the locked position.

As shown, an end 71 of each arm 36 may connect the arm 36 to the hinge 52. The arm 36 may stand vertically upright when in the lifting position (hook part 30"). The range of motion may thus involve moving from a vertical locked position to a vertical lifting position as shown. Such a design provides a handle structure that extends above the top end 28 of the bin 12 in the lifting position, to provide an effective mechanism of removing the liner 10 from the bin 12, while also folding into a compact, locked position when the liner 10 is in the nested position shown inserted in the waste bin receptacle 16.

Referring to FIGS. 1 and 1A, each hook tip 38 may have, in a cross-sectional plane perpendicular to the respective hinge axis 54, one or both a curved exterior surface 88 and a curved interior surface 90. The curved exterior surface 88 and the curved interior surface 90 may converge together at the tip edge 74. The interior surface 90 may contact the skirt 44 in use, while the exterior surface 88 is opposed to the interior surface 90. The surfaces 88 and 90 may collectively form the cross sectional outline of a plunging wave breaker. Such a shape has the advantage of providing an entry wedge portion 92 when extending into the locked position, and an exit wedge portion 94 when moving out of the locked position, to facilitate entry and exit, respectively. A free end 96 of the arm 36 may extend downwardly past the hook tip 38, so that the hook tip 38 is positioned partway between end 96 and end 71 of each arm, with free end 96 providing a gripping point or finger receiver for a user to grip and unlock the tip 38 from engagement with the skirt 44, for example by pulling downwards, laterally outwards, or both at the same time, on free end 96. Hook parts 30 may be formed of rigid but resilient material to permit limited flexing to lock and unlock.

Figure 4:
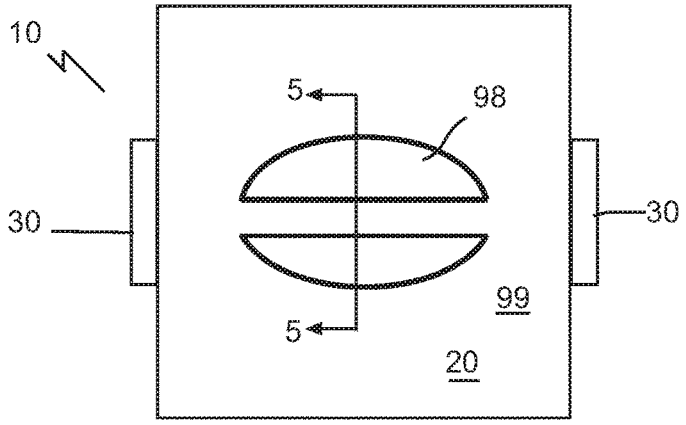
FIG. 4 is a bottom plan view of the rigid liner of FIG. 1.
Figure 5:
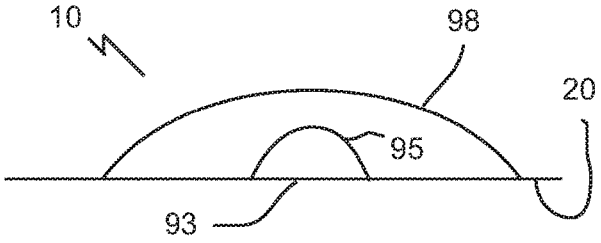
FIG. 5 is a section view taken along the 5-5 section lines from FIG. 4.

Referring to FIGS. 1, 4, and 5, a recessed handle 98 may be formed in an exterior surface 99 of the base 20 of the rigid liner 10. The handle 98 may be positioned within a recess 97, and may have a series, for example a series of four, finger grooves 95. Grooves 95 facilitate gripping, and handle 98 permits a user to dump the liner 10 upside down while holding the handle 98. Because the handle 98 is recessed, in some cases with an external surface 93 flush and flat with the exterior surface 99 of the base, the handle 98 does not interfere with the nesting of the liner 10 in the bin 12. The handle 98 may be formed with the rest of the base 20, for example molded as part of the base 20 and liner 10.

Figure 6:
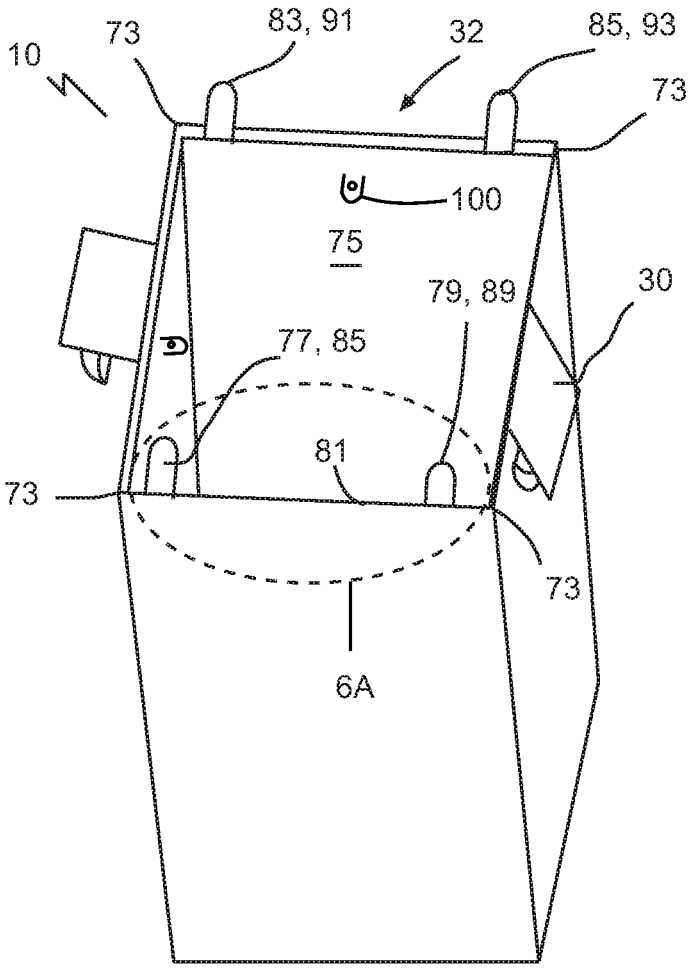
FIG. 6 is a perspective view of the rigid liner and waste bin of FIG. 1 with a plurality of bags nested within the rigid liner.
Figure 6A:
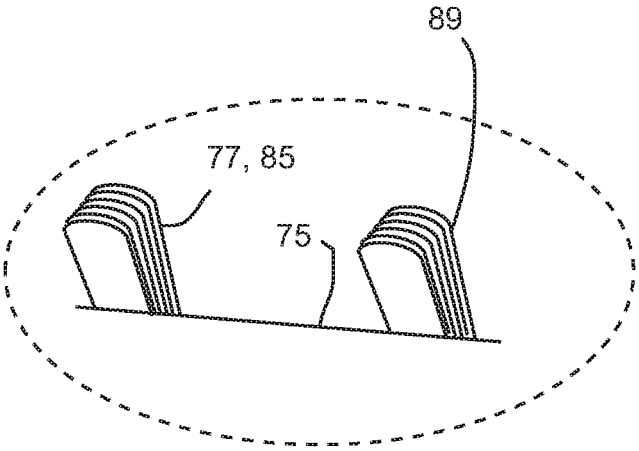
FIG. 6A is a close up view of the area in FIG. 6 bounded by dashed lines and identified by reference numeral 6A.
Figure 7:
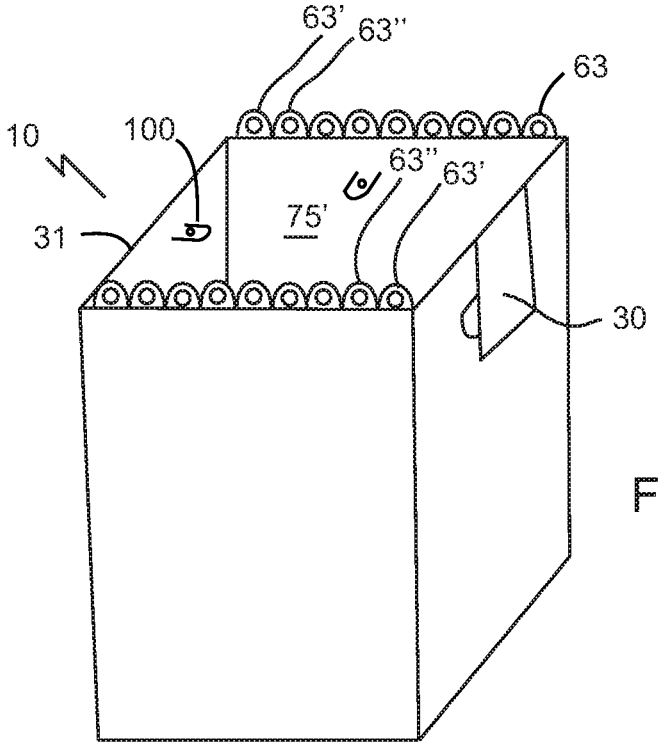
FIG. 7 is a perspective view of a further embodiment of a rigid liner containing a plurality of tabbed garbage bags.

Referring to FIGS. 6 and 7, embodiments are shown in which a plurality of bags 75 are nested within the rigid liner 10. Each bag 75 conforms to an interior shape of the rigid liner 10, for example in a fashion similar to how the liner 10 conforms to the shape of the bin receptacle 16. Referring to FIGS. 6 and 6A, each bag 75 may form first and second tabs 77 and 79, respectively, and in some cases third and fourth tabs 83 and 85, respectively, that project out of a top part or edge 81 of the bag 75. The first tabs 77 of each bag 75 may be layered upon each other to form a first stack 85 of tabs, and the second tabs 79 of each bag 75 may be layered upon each other to form a second stack 89 of tabs. Similarly, third and fourth stacks 91 and 93 of tabs, respectively, may be formed. Each stack 85, 89, 91, and 93 may be located adjacent, for example at or near, respective top corners 73 of the bin liner 10. Thus, pulling at the four points (tabs) of the most interior bag 75 will remove the exposed interior layer or bag, in order for disposal of same. In the example shown each tab also extends above the top end 32 of the liner 10. A user may tie tabs 77 and 85 together, and tabs 79 and 83 together. The liner inserts (bags 75) may extend from the top end 32 of the liner 10 and run continuously through the interior of the insert (liner 10). The inserts may be layered with adhesive points at the flaps or tabs, on the bottom layer at the base (not shown), or at other suitable locations. In some cases the outermost bag 75 (that directly contacts the liner 10) may have adhesive on a base (not shown) of such bag 75 as well as on the tabs.

Referring to FIG. 7 a further embodiment of nested bags 75 is illustrated, with respective tabs 63 that project out of a top part or edge of each bag 75. Each bag 75 has at least two respective tabs 63 spaced around a top perimeter 31 of the liner 10, with the tabs of adjacent bags spaced from the tabs of other adjacent bags. In the example shown, the tabs 63 of each bag 75 are in opposed positions about the top perimeter 31, such that tabs 63' belong to the innermost bag 75', and the tabs 63" belong to the bag 75" (not shown) that bag 75' nests directly within. Each bag 75 forms a layer of film that can be peeled away from the adjacent layer by pulling on the tabs 63' simultaneously. The tabs 63' can also form ties to secure the bag 75 in the closed position with.

Each liner 10 may be sold with a set of nested bags 75 positioned within the liner 10. The liner 10 may be disposed of after a certain period of time or soiling, and replaced with a new liner 10 to continue to protect the waste bin 12 from contamination. The liner 10 may also be cleaned, for example removed and cleaned. Two, three, four or more hook parts 30 may be provided, for example a liner 10 for a waste bin 12 with a square or rectangular cross sectional perpendicular to the bin axis 66 may have hook parts 30 at or adjacent each corner (not shown).

The hinge 52 may be located at a suitable position along the lateral profile of the liner side wall 18 and the hook tip 38. For example, the hinge 52 may be located on the side wall 18 below the top end or edge 32 of the liner 10. The hook part 30 in such an embodiment would be formed by arm 36, liner ledge 34, and the top part (not shown) of the side wall 18 between the liner ledge 34 and the hinge 52. When rotated 180 degrees into the lifting position, the hinge leaves defined by the top and bottom parts of the side wall on either side of the hinge 52 will contact one another so the side wall 18 forms a natural stop to limit further rotation. Also, such an embodiment avoids the use of stops 76 that jut or project out of the liner surface thus potentially obstructing the function of a lid (not shown) placed over the liner 10 and bin 12. In another embodiment, only the hook tip 38 pivots, for example if the hook tip 38 is connected to the arm 36 by hinge 52.

In one embodiment, the hook parts of FIG. 1 are provided as shown, but a slot (not shown) is provided in the liner ledge 34 over the area where the stop 76 would contact on moving into the lifting position if no slot were present. The purpose of the slot would be to permit rotation of arm 34 to cause the stop 76 to contact bin 12, specifically bin ledge 42 to push bin 12 and liner 10 apart on further rotation away from the locked position. Thus, the stop 76 may be used in such an embodiment to separate the bin 12 and liner 10, which may have become otherwise nested tightly within one another perhaps by suction or a close fit over time. In some cases an exterior axial channel (not shown) or channels may be provided down the side wall 18 of the liner 10 in order to avoid the creation of suction between liner 10 and bin 12.

In some cases a lid (not shown) may be used with the combination of the bin 12 and liner 10. For example, the hook parts 30 may be shaped to closely follow the part of the perimeter rim 14 of bin 12 that is contacted and overlain by a lid, in order to minimize interference with the operation of the lid. In other cases the liner 10 is provided with its own lid, perhaps a lid that is sold with the liner 10. The hook parts 30 may form latches that are closed in the locked position, and open in the lifting position to define lifting handles with stable gripping surfaces for a user's hands to grip.

The liner 10 may have a suitable shape defined by reference to a particular targeted waste bin 12. For example, if a waste bin 12 with a circular cross section perpendicular to the bin axis 66 is targeted, the liner 10 also has a circular cross section. Cross sectional shapes other than rectangles and circles may be used. In some cases the liner 10, for example the hook parts 30, overlap all or a portion of the top rim 14 of the bin 12. The liners 10 may be made of suitable material, such as plastic, for further example the same or different type of plastic used to construct the waste bin 12 but provided in a thinner, less rugged, less expensive, disposable version.

Figure 11:
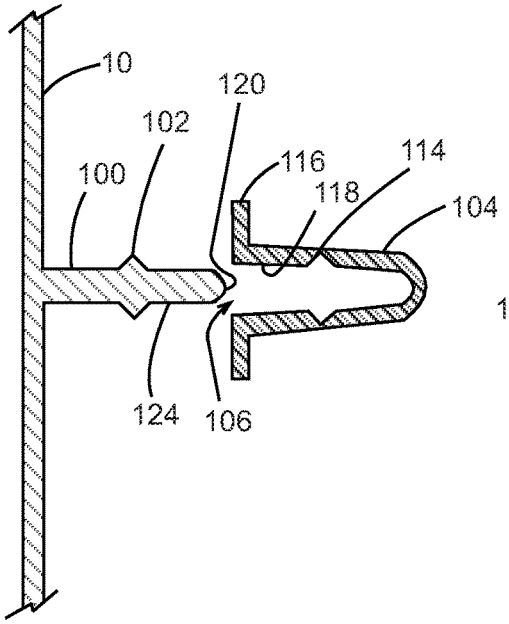
FIG. 11 is an exploded cross-sectional view of the liner male part and corresponding female part before attachment.

Referring to FIGS. 1, 6, 7, 9, 11 and 12, the liner 10 may also contain a plurality of first parts, such as male parts 100, which may be tabs, pins, tongues, or other suitable shapes. Each male part 100 may be shaped to mount a respective second part, such as female parts 104, which may have a groove or other suitable receptacle that receives the male part 100, for example to permit the male part 100 to slide into the female part 104. Referring to FIG. 9, the male parts 100 may extend laterally from an interior surface 111 of side wall 18, and may be connected at or near the top end 32 of the liner 10. The respective female part 104 may be a cap or lid and may be tethered to the male part 100 or the liner 10 by tether 112. Referring to FIGS. 8A, 8B, and 11, the female part 104 may define a hollow opening 106 to allow for male part 100 to fit inside. Referring to FIGS. 8A-8B, female part 104 may have a base flange 116, which may have a bore that has rounded (FIG. 8A) or rectangular sides (FIG. 8B) but is not limited to these shapes.

Figure 12:
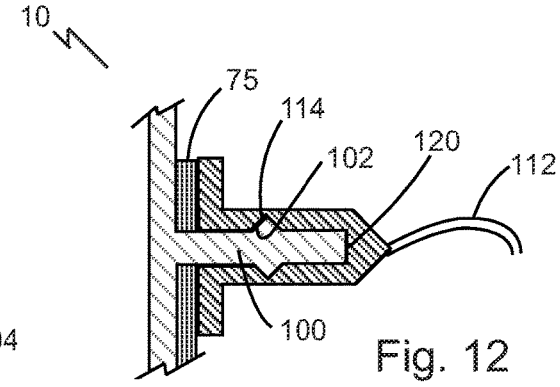
FIG. 12 is a cross-sectional view of the liner male part and female part from FIG. 11 after attachment.
Figure 13:
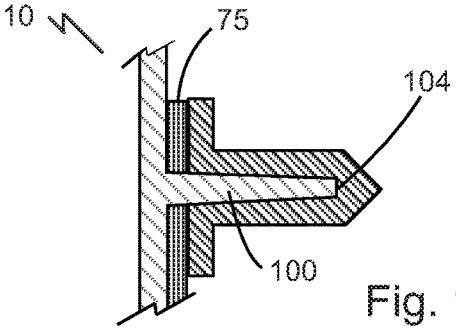
FIG. 13 is a cross-sectional view of a friction-fit embodiment of a liner male part and corresponding female part after attachment.

Referring to FIGS. 10 and 11, the male part 100 may have one or more teeth 102 extending laterally off of male part 100. Referring to FIGS. 11 and 12, female part 104 may have a groove or other suitable receptacle 114 that corresponds with the teeth 102. Female part 104 may also have an inner wall 118 that contacts an outer wall 124 of the male part 100 when mounted. In another case, teeth 102, which may have a suitable shape such as a triangle as shown, may be replaced or supplemented with secondary female or male parts, which correspond with respective male or female parts in the female part 104. The teeth 102 and receptacle 114 are an example of a locking mechanism that acts to resist removal of the female part 104 once mounted. Another example is a friction fit (for example an interference fit between parts 100 and 104, see FIG. 13, with one or both parts 100 and 104 forming a tapered mating profile as shown) or shark teeth engagement. One or both of the male and female parts 100 and 104, respectively, may be made from resilient material to permit flexing to allow female part 104 to be released from male part 100 under sufficient force.

Referring to FIG. 12 male parts 100 may support one or more of a plurality of bags 75 between male and female parts 100 and 104 when mounted together. To facilitate supporting bags 75 the female part 104 may be configured to be spaced from side wall 118 when in the mounted position shown. Referring to FIGS. 11 and 12, the tip 120 of male part 100 may be rounded (FIG. 11) or rectangular (FIG. 12) in cross-section but is not limited to either forms. In other cases the first parts may be female and the second parts may be male.

Figure 14:
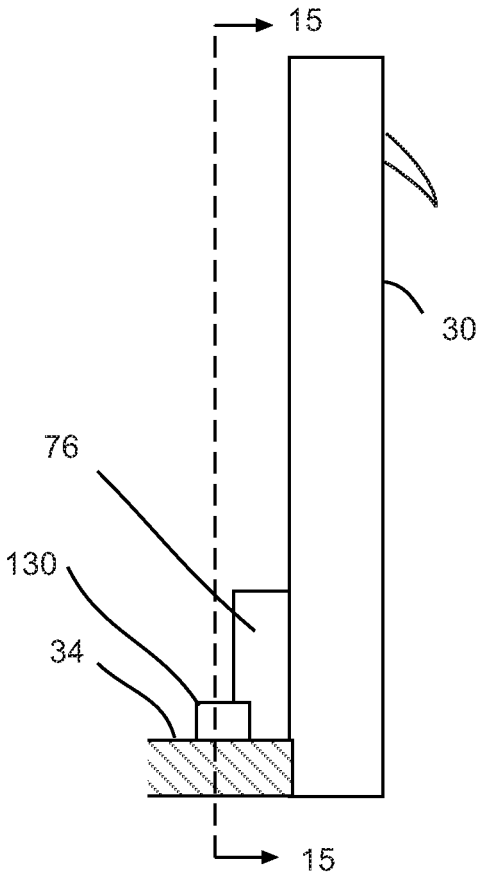
FIG. 14 is a side elevation partial section view of a liner ledge with a stop retainer for securing the stop of the handle in the lifting position.
Figure 15:
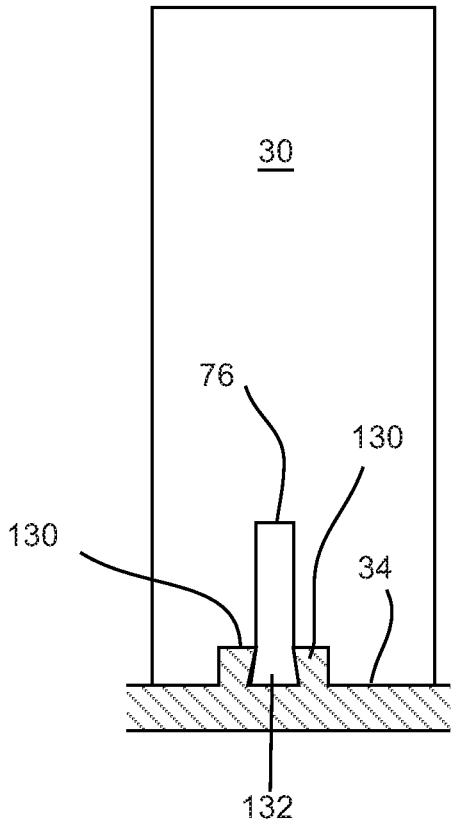
FIG. 15 is a section view taken along the 15-15 section lines of FIG. 14.

Referring to FIGS. 14 and 15 a mechanism may be provided to retain the hook parts 30 in the lifting position. For example, a pair of stop retainers such as shoulders 130 may be laterally spaced along liner ledge 34 to engage a base end 132 of the stop 76 of the hook part 30. The shoulders 130 may be tapered with increasing separation between shoulders with decreasing distance from the liner ledge 34. Other retaining mechanisms may be used, such as a ball and ball retainer, or a latch system. The retaining mechanism may have an interference, friction, snap or other suitable fit, and may have a separate mechanism to lock and unlock the retaining mechanism.

Rigid may mean liner 10 has a continuously stiff structure from a top end to a base end of the liner 10. Some resiliency may be provided in the liner 10. Liner 10 may be formed by molding or other suitable methods, for example 3D printing. In one embodiment, the liner 10 and clips or hook parts 30 are manufactured individually via 3D printing, and the hook parts 30 and liner 10 are assembled afterward. Words such as vertical, horizontal, top, base, bottom, and other directional and reference language are not intended to be restricted to absolute terms defined with respect to the direction of gravitational acceleration on the earth, and are instead intended to be relative, for example relative to the bin 12 itself. The open top of the receptacle 16 and liner 10 may be referred to as a top access opening or open mouth. The hook parts 30 may form a snap fit to the ledge skirt 44. The skirt 44 may not run continuously around the perimeter.

The hook parts 30 may be spaced from one another about the top end 32 or perimeter of the rigid liner 10. The method may comprise placing waste within the liner 10, and dumping the contents of the liner 10 and bin 12, while the liner 10 is locked to the bin 12. The method may comprise lowering the liner 10 into the bin 12 using the handles or hook parts 30. The liner 10 may form a watertight enclosure, and may be made of material resistant to transfer of chemicals and other substances across the liner wall, to prevent inadvertent transport of waste into contact with the bin 12. Hook parts 30 may be formed integrally with the rest of the liner 10.

In some cases axial forces on the locked hook parts 30, such as when dumping the bin, will not open the hook parts, but lateral forces from rotation of the hook part 30 about the hinge 52 will unlock. For examples where each item is said to have such and such a feature or quality, it should be understood that such examples also include examples where only one or more such items have the feature or quality, unless context dictates otherwise.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The invention claimed is:

1. A method comprising:

inserting a rigid liner into a receptacle of a waste bin, the rigid liner conforming to an interior shape of the receptacle;

extending a plurality of hook parts from the rigid liner in sequence over and under a perimeter rim of the waste bin to lock the rigid liner to the waste bin;

in which each hook part connects to the rigid liner by a respective hinge; and in which each hinge has a hinge axis parallel to a part of a perimeter axis of the rigid liner that is adjacent the hinge, and extending further comprises rotating each hooking part in a downward direction into a locked position.

2. The method of claim 1 further comprising:

unlocking the plurality of hook parts from the perimeter rim; and lifting the rigid liner from the waste bin by gripping the plurality of hook parts.

3. The method of claim 2 in which:

the perimeter rim is formed by a bin ledge and a skirt, the bin ledge extended laterally outward from a top part of the waste bin, with the skirt depending from the bin ledge;

each hook part has an arm with a hook tip that projects upward and laterally inward from the arm, and laterally inward of the skirt, when in the locked position; and each hook tip and arm collectively define a finger receiving cavity that faces downward when in the lifting position.

4. The method of claim 3 in which each hook part has a range of motion about the respective hinge between the locked position and the lifting position, the range of motion being at least ninety degrees.

5. The method of claim 4 in which the range of motion is at least one hundred eighty degrees.

6. The method of claim 4 in which an end of each arm connects to the hinge axis, and the arm stands vertically upright when in the lifting position.

7. The method of claim 4 in which each finger receiving cavity comprises a plurality of finger receiving grooves.

8. The method of claim 4 in which rotation, past the lifting position in a direction away from the locked position, is limited by a stop associated with the respective hinge.

9. The method of claim 8 in which each stop comprises a projection from an exterior surface of the respective arm adjacent the hinge.

10. The method of claim 9 in which the projection has the shape of a triangle in a cross-sectional plane perpendicular to the hinge axis, in which an edge, of the triangle, that is closest to the hinge extends perpendicular to the exterior surface of the respective arm.

11. The method of claim 3 in which each hook tip has, in a cross-sectional plane perpendicular to the hinge axis, a curved exterior surface and a curved interior surface, the curved exterior surface and the curved interior surface converging together at a tip edge.

12. The method of claim 1 in which each hinge defines an outer lateral edge of a liner ledge, which is extended laterally over the perimeter rim.

13. The method of claim 1 in which a plurality of bags are nested within the rigid liner, each bag conforming to an interior shape of the rigid liner.

14. The method of claim 13 in which each bag forms first and second tabs that project out of a top part of the bag.

15. The method of claim 14 in which the first tabs of each bag are layered upon each other to form a first stack of tabs, the second tabs of each bag are layered upon each other to form a second stack of tabs and each bag forms third and fourth tabs that project out of the top part of the bag, the third tabs of each bag are layered upon each other to form a third stack of tabs, the fourth tabs of each bag are layered upon each other to form a fourth stack of tabs, and the first stack, second stack, third stack, and fourth stack are located adjacent respective top corners of the rigid liner.

16. The method of claim 13 in which the rigid liner contains a plurality of first parts, each being one of a male or female part and mounting a respective second part that is the other of a male or female part, and supporting one or more of the plurality of bags between the first part and the respective second part.

17. A combination comprising the rigid liner and waste bin of claim 1.

18. A method comprising:

inserting a rigid liner into a receptacle of a waste bin, the rigid liner conforming to an interior shape of the receptacle;

extending a plurality of hook parts from the rigid liner in sequence over and under a perimeter rim of the waste bin to lock the rigid liner to the waste bin, in which each hook part connects to the rigid liner by a respective hinge;

unlocking the plurality of hook parts from the perimeter rim; and lifting the rigid liner from the waste bin by gripping the plurality of hook parts;

in which:

the perimeter rim is formed by a bin ledge and a skirt, the bin ledge extended laterally outward from a top part of the waste bin, with the skirt depending from the bin ledge;

each hook part has an arm with a hook tip that projects upward and laterally inward from the arm, and laterally inward of the skirt, when in the locked position; and each hook tip and arm collectively define a finger receiving cavity that faces downward when in the lifting position.

* * * * *